US005190283A

United States Patent [19]

Hannon

[11] Patent Number: 5,190,283

[45] Date of Patent: Mar. 2, 1993

[54] REVERSIBLE GOLF CUP HOLE PROTECTOR AND METHOD OF MANUFACTURE

[76] Inventor: Gerard M. Hannon, 1746 NW. 84th Dr., Coral Springs, Fla. 33071

[21] Appl. No.: 822,040

[22] Filed: Jan. 14, 1992

[51] Int. Cl.[5] ..... A63B 57/00

[52] U.S. Cl. ..... 273/34 R; 40/642; 273/178 R

[58] Field of Search ..... 273/34 R, 34 A, 34 B, 273/177 R, 177 A, 177 B, 178 R, 178 A, 179 E, 181 A; 40/642, 651

[56] References Cited

U.S. PATENT DOCUMENTS

| | | | |
|---|---|---|---|
| 1,813,696 | 7/1931 | Crocker | 273/34 R |
| 2,031,525 | 2/1936 | Clarke | 273/178 R |
| 2,283,462 | 5/1942 | Richie | 273/178 A |
| 2,457,759 | 12/1948 | Wales | 273/34 A |
| 4,928,417 | 5/1990 | Boudreau | 273/34 R X |
| 5,029,856 | 7/1991 | Bookspan | 273/34 R |

*Primary Examiner*—George J. Marlo
*Attorney, Agent, or Firm*—Malin, Haley, McHale, DiMaggio & Crosby

[57] ABSTRACT

A reversible protective device for the bottom of a golf cup formed from a single sheet of flexible material into a conical shape for directional insertion into a conventional golf cup. The device incorporates a method of manufacture that is low in cost and allows placement of coloration or advertisement on the sheet before formation into the conical shape. The device prevents damage to the surface of the golf cup by absorbing the impact of flag pole replacement.

20 Claims, 4 Drawing Sheets

REVERSIBLE GOLF CUP HOLE PROTECTOR AND METHOD OF MANUFACTURE

FIELD OF INVENTION

This invention relates generally to the field of golf and, in particular, to an apparatus and method of manufacture for protecting the surface of a golf cup by use of a disposable device which absorbs the impact of flag pole replacement.

BACKGROUND OF THE INVENTION

Golf is a game known throughout the world. The object of the game is to put a golf ball into a golf cup in as few of attempts or "strokes" as possible. The location of the golf cup is depicted by use of a flag situated on top of a flag pole held securely by the golf cup. When a player or "golfer" is close to the golf cup the flag pole is removed so as not to obstruct the golfer from putting the golf ball into the golf cup. Once the golfer has performed this feat the flag pole is returned to its original position.

Next to the golf ball, the golf cup is one of the most abused items in the game. The problem with the golf cup is that after minimal use the golf cup takes on an unsightly appearance. As previously mentioned, when a golfer has completed their play the golfer returns the flag pole to the golf cup. Anyone who has played the game of golf realizes flag pole replacement is nothing more than jamming the flag pole into the golf cup with hopes that it will situate itself in the proper location. If the golf cup is metal and painted, replacement typically chips the paint. If the cup is plastic, replacement may chip the cup.

Further, physical movement of the golf cup is performed daily to prevent excessive wear to the playing area surrounding the golf cup. Since the placement of the golf ball within the golf cup is the focus of the game, every person who plays the game must stand next to the golf cup to retrieve his golf ball. The result is excessive wear to the putting green around the hole. Physical movement of the cup requires a tool that is twisted into the bottom of the golf cup in such a manner that leverage is obtained for lifting. This movement results in physical contact with the bottom surface of the golf cup leading to additional chipping or like damage.

Current maintenance of the golf cup is expensive. Ideally, the golf cup remains on the putting green throughout the playing season. A conventional golf cup becomes an unsightly hole that must be exchanged with a new or repainted cup else leave a poor impression with the customer. Exchanging cups every few weeks for new or repainted cups is impractical and expensive.

Green keepers painstakingly maintain their golf course realizing that the beauty of the course is a key element in attracting return customers. Yet while a golfer may look at the golf course as a whole, it is assured that the golfer will look at, and physically reach their hand into, each and every golf cup on the golf course. A badly chipped or damaged golf cup reflects on the overall appearance of the course.

U.S. Pat. No. 4,928,417 issued to Boudreau discloses a device that is placed in the bottom of a golf cup. Boudreau teaches the use of a performed plastic device that is expensive to manufacture and not universally applicable due to its dependence upon attachment to drainage holes of the golf cup. Boudreau device is not reversible, is difficult to print upon, and storage is inconvenient due to its particular shape.

It is, therefore, to the effective resolution of the aforementioned problems and shortcomings of the prior art that the present invention is directed.

SUMMARY OF INVENTION

Generally, the instant invention relates to a golf cup protector and method of manufacture. The protective device of the instant invention comprises a sheet of flexible material constructed of plastic, rubber, or a paper material made waterproof. The sheet is substantially flat in its formation and can be cut from a sheet of material having existing advertisements thereon; or a blank sheet of material for later printing upon; or simply a blank sheet of material having a lack of advertising.

The sheet is cut to create a substantially circular device with an acute opening leading to a center section for flag pole insertion. In the preferred embodiment, a portion of the sheet is employed for coupling the sides of the acute opening together to form a conical shape. The shape conforming to the bottom surface of a conventional golf cup. The device resides on the bottom surface of the cup by means of gravity or, alternatively, by attaching to the golf cup. For example, the device can be attached to the bottom of the cup by adhesive, tape, magnets, hook and pile, and so forth. Optionally, the outer periphery of the device includes a plurality of flexible tabs extending therefrom or a periphery conforming to the side wall of a conventional golf cup for friction fit thereto. The attachment means maintaining the device in position until removed. Finally, the protective device is reversible allowing the surface contacting the surface of the golf cup to be inverted thereby exposing the unused portion of the device or a new advertising display.

Accordingly, it is the primary object of the present invention to provide a disposable device for protection of the bottom surface of golf cups.

Another object of the present invention is to provide a low cost method of manufacturing golf cup protectors, the protector formed and shipped in a flat position.

Still another object of the present invention is to provide a low cost means for advertising at the bottom of a golf cup.

Yet still another object of the present invention is to provide a reversible device having disparate advertising on each side surface, allowing the device to be changed to display either side surface.

Other objects and advantages of this invention will become apparent from the following description taken in conjunction with the accompanying drawings wherein set forth, by way of illustration and example, certain embodiments of this invention. The drawings constitute a part of this specification and include exemplary embodiments of the present invention and illustrate various objects and features thereof.

BRIEF DESCRIPTION OF THE DRAWINGS

The invention may be better understood by reference to the drawings in which.

DETAILED DESCRIPTION OF THE INVENTION

As required, detailed embodiments of the present invention are disclosed herein, however, it is to be understood that the disclosed embodiments are merely exemplary of the invention which may be embodied in various forms. Therefore, specific functional and structural details disclosed herein are not to be interpreted as limiting, but merely as a basis for the claims and as a representative basis for teaching one skilled in the art to variously employ the present invention in virtually any appropriately detailed structure.

Figure 1:
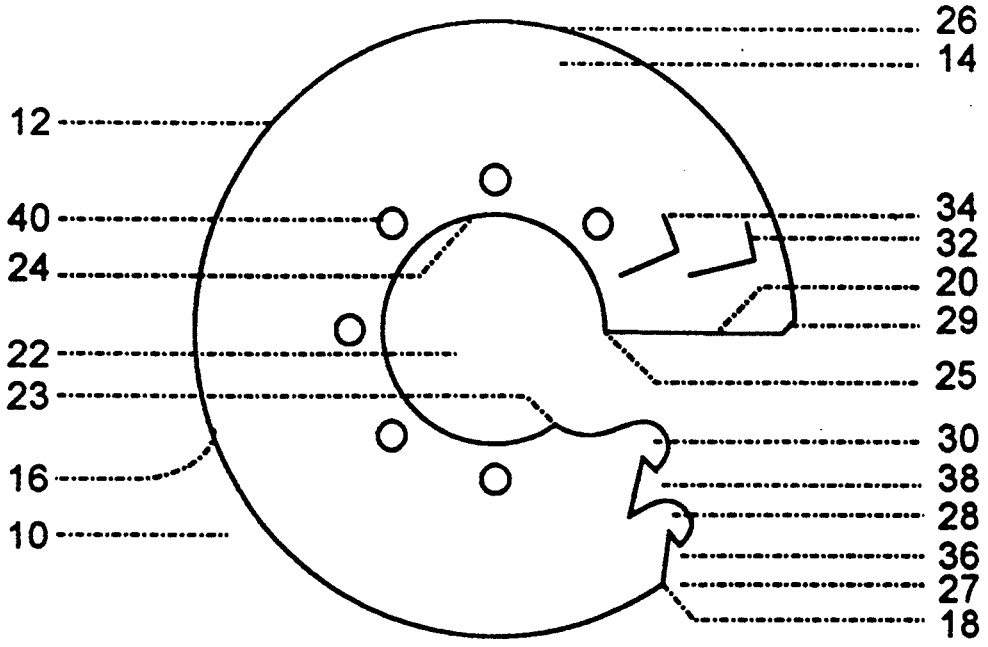
FIG. 1 is a top view of the instant invention.

Referring to FIG. 1, the protective device 10 of the instant invention comprises a sheet of flexible plastic, rubber, or coatable paper material depicted by numeral 12. Plastic can be transparent, translucent, or opaque. The sheet is substantially flat in its formation defined by first side surface 14 and second side surface 16. An acute opening is placed in the sheet 12 outlined by first coupling edge 18 and second coupling edge 20. A center opening 22 is disposed in the center of sheet 12 sized to allow insertion of a conventional flag pole therethrough as described in detail later in this specification. The perimeter edge 24 of the center opening 22 begins at the inner corner 23 of the first coupling edge 18 and ends at the inner corner edge 25 of the second coupling edge 20. The outer periphery 26 of the sheet 12 is substantially circular beginning at the outer corner 27 of the first coupling edge 18 and ending at the outer corner 29 of the second coupling edge 20. Corner 29 is shown chamfered to eliminate a sharp point. Means for locking first coupling edge 18 to second coupling edge 20 comprises tabs 28 and 30 extending obliquely from first coupling edge 18 engagable with and separated from second coupling edge 20 by the aforementioned acute opening. The second coupling edge 20 having corresponding slots 32 and 34 disposed therein for coupling thereto. To lock tab 28 into slot 32, a triangular shaped notch 36 is placed in the tab 28 wherein one edge of the notch 28 is made parallel to or part of first coupling edge 18. Similarly, to lock tab 30 into slot 34 a triangular shaped notch 38 is placed in the tab 30 wherein one edge of the notch 38 is made parallel to or part of the first coupling edge 18. It should be noted at this point that any means of coupling first coupling edge 18 to second coupling edge 20 is deemed within the scope of this invention. The locking means may comprise two way adhesive tape, loop and pile attachment, magnetic attraction, and so forth. The locking means does not seal the coupling edges together allowing sufficient drainage in most instances. In areas having excessively moist conditions, a plurality of drainage holes 40 can be placed in the device.

In addition, an advertisement or message can be placed on either side surface of the sheet. If the sheet is made from transparent or translucent plastic, an advertisement placed against the bottom of the cup protects the advertisement from scratches. If an opaque plastic is utilized, a different advertisement can be placed on either side of the sheet allowing the sheet to be reversed to expose alternate advertisements.

Figure 2:
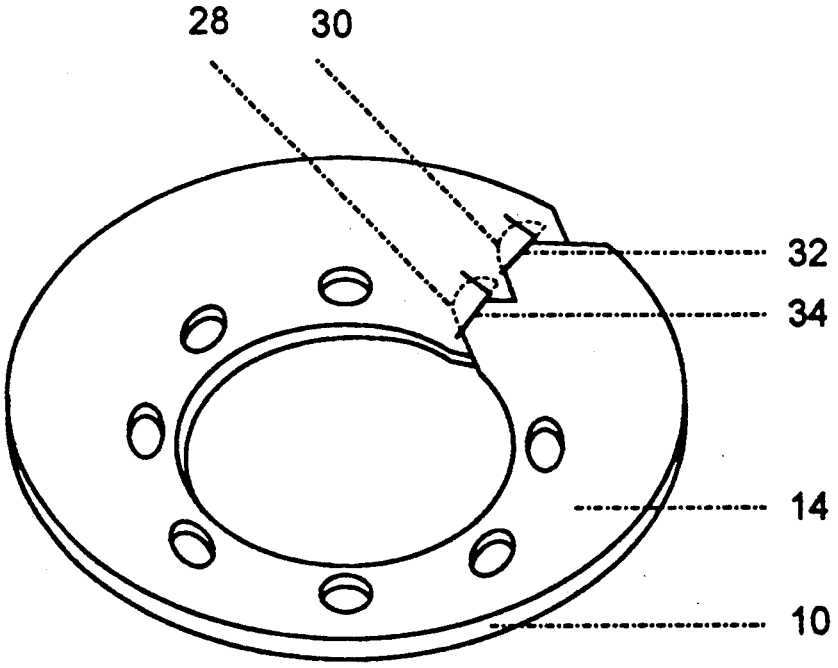
FIG. 2 is a perspective view of the instant invention with coupling edges locked.
Figure 3:
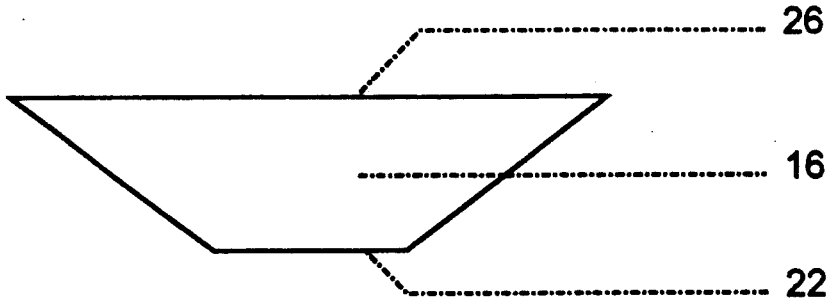
FIG. 3 is a side view of the instant invention with the coupling edges locked.

Now referring to FIGS. 2 and 3, the instant device is made operational by placing first coupling edge 18 and second coupling edge 20 juxtapose holding their position by said locking means. The locking means in this embodiment consists of insertable tabs 28 and 30 depicted inserted into slots 34 and 32 respectively. Slidable movement of first coupling edge 18 outwardly toward edge 29 causes notch 36 and 38 to engage second surface 16 locking the first coupling edge 18 to the second coupling edge 20. Upon locking, the device forms a conical arrangement with surface 14 forming an inner surface and surface 16 forming an outer surface. The conical shape is easily insertable in one direction into a golf cup with the outer periphery 26 forming a continuous perimeter dimensioned to co-axially fit into a conventional golf cup. Optionally, the outer periphery of the device includes a plurality of tabs, not shown, extending therefrom or a periphery conforming to the side wall of a conventional golf cup for friction fit by biasing the device against the inner surface of the golf cup. It should be noted that the device can be inverted causing outer surface 16 to become an inner surface.

Figure 4:
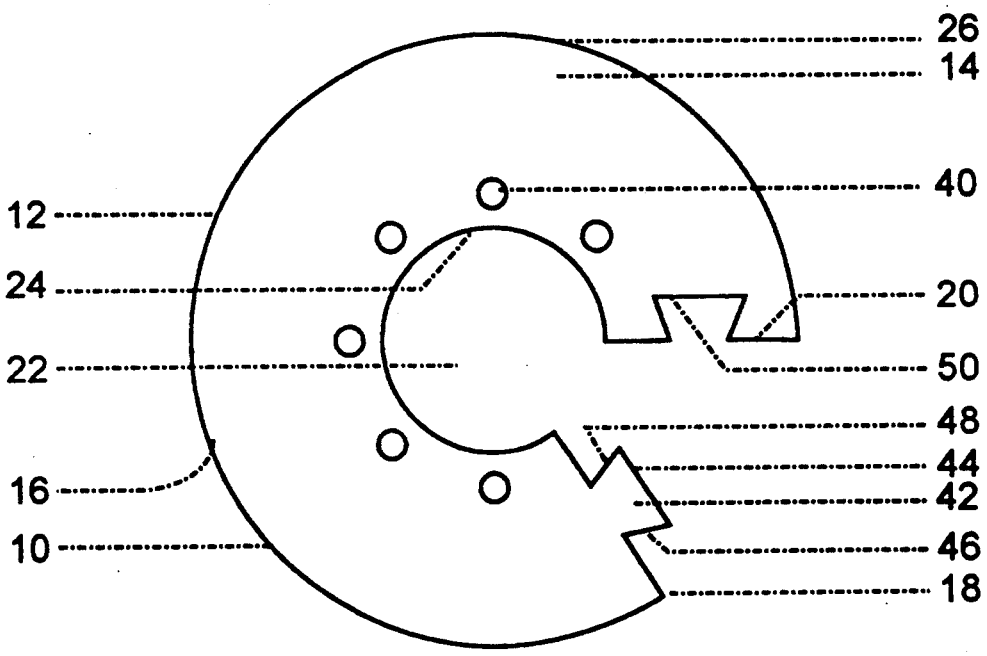
FIG. 4 is a top view of the instant invention illustrating an alternative locking mechanism.

Now referring to FIG. 4, an alternative locking means is depicted wherein the protective device 10 is shown as a substantially flat piece of material defined by first side surface 14 and second side surface 16. The sheet is available for display of an advertisement thereon. Formation of the device requires an acute opening be placed in a section of sheet 12 depicted by first coupling edge 18 and second coupling edge 20. Center opening 22 is defined by inner perimeter edge 24. The outer circumference of the sheet is substantially circular creating outer periphery 26. Means for locking first coupling edge 18 to second coupling edge 20 comprises tab 42 formed in the shape of a trihedral wedge having a top edge and a first edge 46 and second edge 48 extending obliquely from first coupling edge 18 engagable with and separated from second coupling edge 20 by the aforementioned acute opening. The second coupling edge 20 includes a corresponding notch 50 disposed therein for coupling thereto.

The method of manufacture for the instant device is low cost and allows printing before or after manufacture, on either side of the device, while in a flatten state. Further, the device can be stored, shipped, and taken to point of use in the flatten state. Manufacture of the golf cup protective device comprising the steps of:

(a) cutting a flexible sheet of material into a predetermined pattern having a substantially circular inner and outer circumference with an acute opening defined by two edges communicating the inner and outer circumference;

(b) optionally placing an advertisement on said sheet of material;

(c) optiionally punching a plurality of drain holes through said sheet of material;

(d) providing a means for locking the edges of the acute opening in a fixed position;

(e) forming said sheet into a conical shape and placing said two edges of the acute opening juxtapose;

(f) locking said edges together by said means for locking; (g) inserting said conical shaped device into a conventional golf cup.

Figure 5:
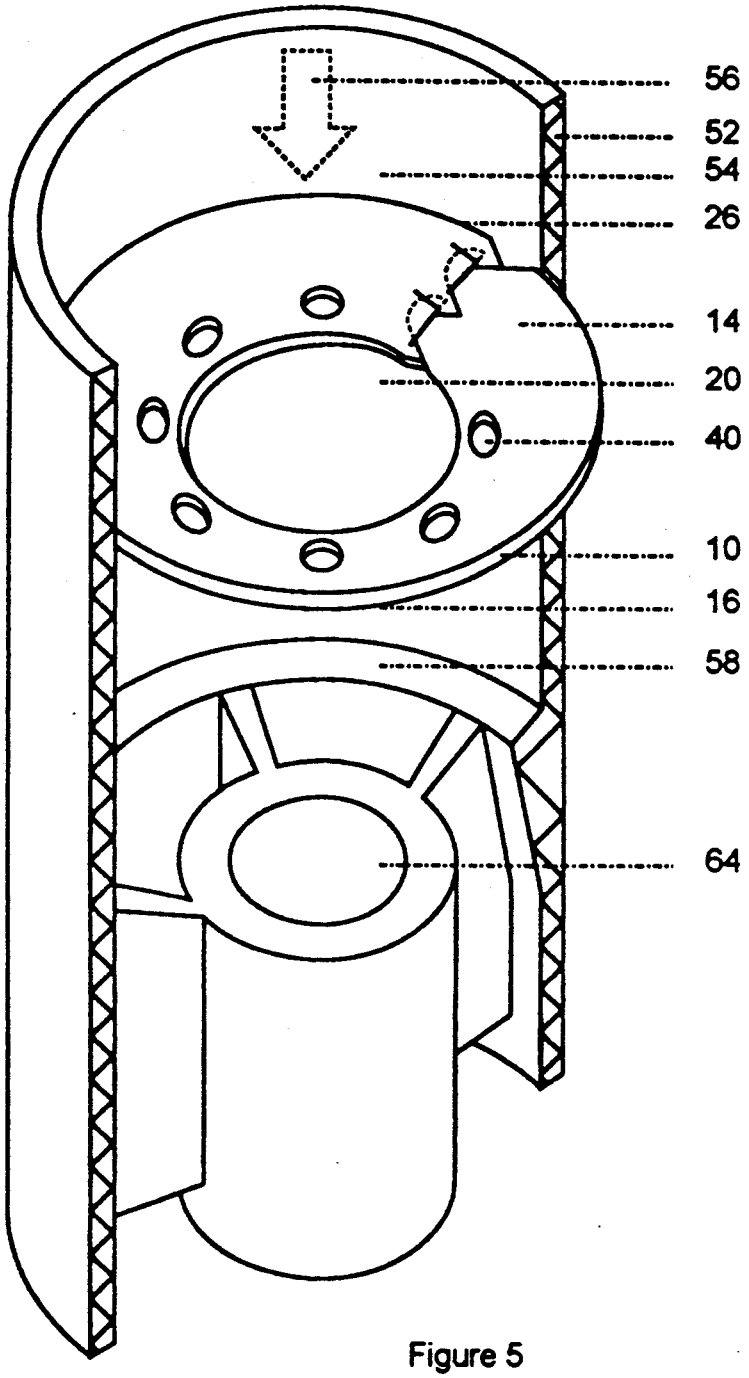
FIG. 5 is a perspective cross sectional view of the instant invention insertable into a conventional golf cup.
Figure 6:
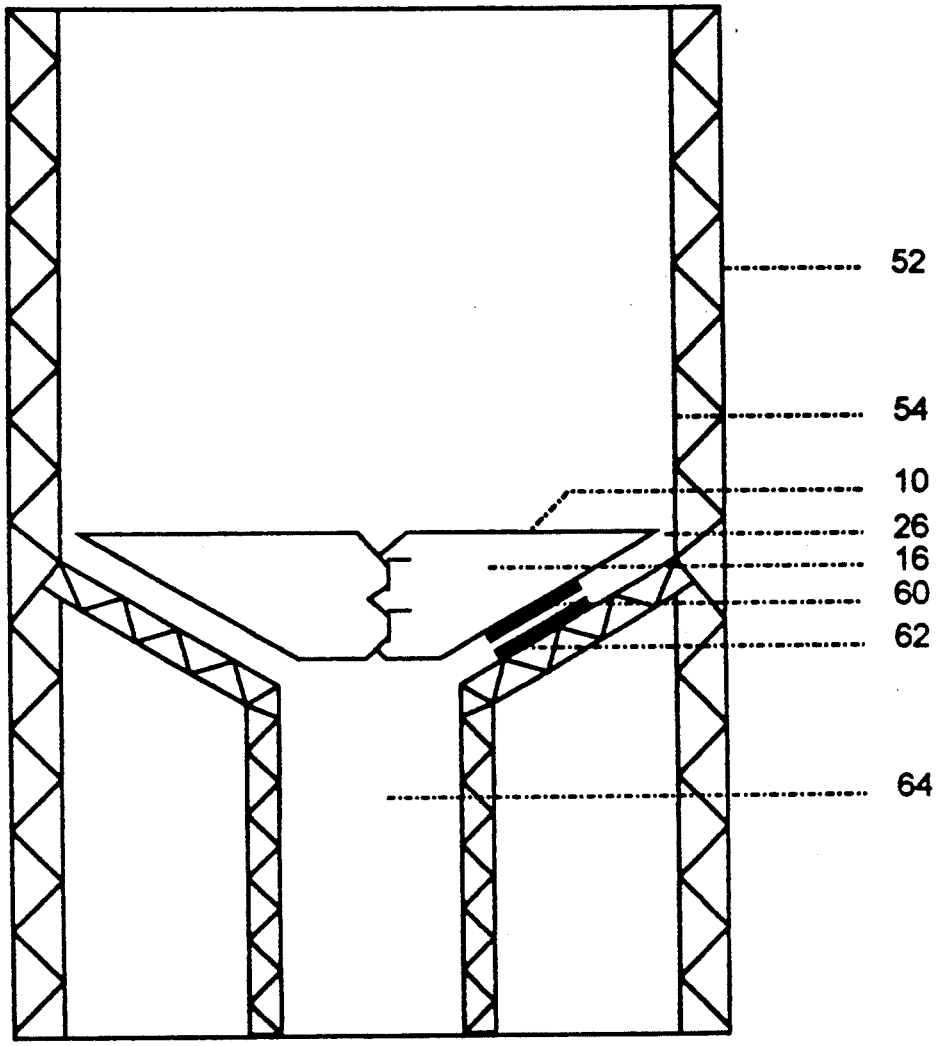
FIG. 6 is a cross sectional view of the instant invention with the instant invention inserted in a conventional golf cup, wherein the device is disposed along the bottom surface of the cup.

FIGS. 5 and 6 illustrate the instant device 10 with its angular surface 14 formed in the same angular shape of the bottom surface 58 of a conventional golf cup 52. In a alternative embodiment, the outer periphery 26 of the device 10 frictionally engages the inner surface 54 of the golf cup 52 causing the device to bias against the two surfaces 26 and 54 creating a slidable insertion in the direction of the arrow 56. The device is slid into the golf cup until the bottom surface 16 of the device 10 contacts the upper surface 58 of the conventional cup.

As previously mentioned, an alternative embodiment for maintaining the device in the bottom of a golf cup is by use of frictional engagement between surfaces 26 and 54. Alternatively, a means for maintaining the device at the bottom of the cup may comprise two way adhesive tape, loop and pile attachment, magnetic attraction, and so forth as depicted by components 60 and 62. The opening 20 is dimensionally larger than a conventional golf flag pole, not shown, allowing the end of the pole to pass through the center 20 of the device 10 for seating into hole 64 provided for flag pole erection. Drain holes 40 allow excess water to flow through the device 10 in the event the flag poles prevents normal draining. When the device is to be exchanged, it can be removed from the golf cup by overcoming the frictional engagement of edge 26 to wall 54. Movement of the tabs unlocks the device from its conical position and allows the device to be reformed into a reverse conical shape for inverted replacement into the golf cup hole.

It is to be understood that while we have illustrated and described certain forms of my invention, it is not to be limited to the specific forms or arrangement of parts herein described and shown. It will be apparent to those skilled in the art that various changes may be made without departing from the scope of the invention and the invention is not to be considered limited to what is shown in the drawings and described in the specification.

What I claim as new and desire to secure by Letters of the United States is:

1. A golf putting cup including a protective device for the bottom of said golf cup, said protective device comprising: a sheet of flexible material having at least two side surfaces, first and second coupling edges, a center opening and an outer periphery; and, means for locking said first and second coupling edges together so that said first and second coupling edges are juxtaposed and said sheet is a conical shape for ease of insertion into the golf cup.

2. The golf cup and protective device according to claim 1, wherein said means for locking comprises a first coupling edge having at least one tab extending obliquely from said first coupling edge engagable with said second coupling edge.

3. The golf cup and protective device according to claim 2, wherein said locking tab has a triangular shaped notch, one edge of said notch being parallel to the first coupling edge.

4. The golf cup and protective device according to claim 3 wherein said locking tab is releasably insertable into a slot disposed in said second coupling edge.

5. The golf cup and protective device according to claim 2, wherein said locking tab located on said first coupling edge is a trihedral wedge having a top edge and two sides operatively associated with said first coupling edge.

6. The golf cup and protective device according to claim 5 wherein said locking tab is releasably attachable to a trihedral wedge patterned cutout located in said second coupling edge.

7. The golf cup and protective device according to claim 1, wherein said sheet has a circular periphery forming a continuous periphery dimensioned to co-axially fit into said golf cup.

8. The golf cup and protective device according to claim 1, wherein said sheet is includes a display of an advertisement thereon.

9. The golf cup protective device according to claim 1, wherein said sheet includes a plurality of drainage holes placed therethrough.

10. The golf cup and protective device according to claim 1, wherein said outer periphery of said sheet is dimensionally larger than said golf cup whereby said sheet formed into a conical shape is biased against the inner surface of the golf cup for friction attachment thereto.

11. The golf cup and protective device according to claim 1, wherein sheet is constructed of plastic.

12. The golf cup and protective device according to claim 1, wherein sheet is constructed of a coated paper material.

13. The golf cup and protective device according to claim 1, wherein said first coupling edge and said second coupling edge form an acute angle.

14. The golf cup and protective device according to claim 1, wherein sheet is constructed of rubber.

15. The golf cup and protective device according to claim 1 further comprising a means for releasably securing said sheet to the bottom of said golf cup.

16. The golf cup and protective device according to claim 1 said sheet is reversible.

17. A method of manufacture for a golf cup protective device comprising the steps of:

(a) cutting a flexible sheet of material into a predetermined pattern having a substantially circular inner and outer periphery with an acute opening defined by two edges communicating the inner and outer periphery;

(b) providing a means for locking the edges of the acute opening in a fixed position;

(c) forming said sheet into a conical shape and placing said two edges of the acute opening juxtapose, (d) locking said edges together by said means for locking;

(e) inserting said conical shaped device into a conventional golf cup for positioning along the bottom surface of said cup.

18. A golf putting cup including a reversible protective device for the bottom of said golf cup, said protective device comprising: a sheet of flexible material having at least two side surfaces capable of displaying an advertisement thereon and a plurality of drainage holes placed therethrough; a first coupling edge having at least one tab extending obliquely from said first coupling edge engagable with and separated from a second coupling edge by an opening, said second coupling edge having a slot disposed therein; a center opening and an outer substantially circular periphery; and, means for locking said first and second coupling edges together; so that said first and second coupling edges are placed juxtaposed and said sheet is held in a conical shape for ease of insertion into the golf cup, said conical shape employing said outer circular periphery to form a continuous periphery dimensioned to co-axially fit and be biased against the inner surface of the golf cup for friction attachment thereto.

19. The golf cup and protective device according to claim 18 wherein sheet is constructed of plastic.

20. The golf cup and protective device according to claim 18, wherein sheet is constructed of a coated paper.

* * * * *